US008175500B2

(12) United States Patent
Okuda

(10) Patent No.: US 8,175,500 B2
(45) Date of Patent: May 8, 2012

(54) TONER CARTRIDGE AND IMAGE FORMING APPARATUS USING THE SAME

(75) Inventor: Takeshi Okuda, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 42 days.

(21) Appl. No.: 12/834,966

(22) Filed: Jul. 13, 2010

(65) Prior Publication Data

US 2011/0026975 A1 Feb. 3, 2011

(30) Foreign Application Priority Data

Jul. 30, 2009 (JP) ..... 2009-177859

(51) Int. Cl.
*G03G 15/08* (2006.01)

(52) U.S. Cl. ..... 399/263; 399/258

(58) Field of Classification Search ..... 399/263, 399/262, 258, 260, 254
See application file for complete search history.

(56) References Cited

U.S. PATENT DOCUMENTS

| | | | | |
|---|---|---|---|---|
| 5,812,916 | A | 9/1998 | Kishimoto et al. | 399/263 |
| 6,405,010 | B2 * | 6/2002 | Ashikari et al. | 399/262 |
| 6,556,800 | B2 * | 4/2003 | Matsuda et al. | 399/258 |
| 2006/0182467 | A1 | 8/2006 | Aoki et al. | 399/254 |
| 2008/0056772 | A1 * | 3/2008 | Utsumi et al. | 399/254 |
| 2009/0257785 | A1 * | 10/2009 | Okuda et al. | 399/263 |
| 2010/0003057 | A1 * | 1/2010 | Okuda et al. | 399/263 |

FOREIGN PATENT DOCUMENTS

| | | |
|---|---|---|
| JP | 10-149005 | 2/1998 |
| JP | 2001-083802 A | 3/2001 |
| JP | 2005-250517 | 9/2005 |
| JP | 2006-227149 | 8/2006 |
| JP | 2008-216360 A | 9/2008 |
| JP | 2008-276154 | 11/2008 |
| JP | 2009-237141 A | 10/2009 |

* cited by examiner

*Primary Examiner* — Sophia S Chen
(74) *Attorney, Agent, or Firm* — Nixon & Vanderhye P.C.

(57) ABSTRACT

A toner cartridge includes: a toner storing portion for storing toner; a toner discharging portion having a toner discharge port; and a screw auger having a rotary shaft and a helical blade for conveying the toner in the toner storing portion to the toner discharging portion. The helical blade includes a first helical blade portion located over the toner discharge port and a second helical blade portion located in the toner storing portion. The first toner thrust face of the first helical blade portion, located on the downstream side with respect to the toner conveying direction is formed at a first inclination angle to the axial direction of the rotary shaft. The second toner thrust face of the second helical blade portion, located on the downstream side with respect to the toner conveying direction is formed at a second inclination angle to the axial direction of the rotary shaft. The first inclination angle is formed to be smaller than the second inclination angle.

3 Claims, 7 Drawing Sheets

TONER CARTRIDGE AND IMAGE FORMING APPARATUS USING THE SAME

This Nonprovisional application claims priority under 35 U.S.C. §119 (a) on Patent Application No. 2009-177859 filed in Japan on 30 Jul. 2009, the entire contents of which are hereby incorporated by reference.

BACKGROUND OF THE TECHNOLOGY (1) Field of the Technology

The present technology relates to a toner cartridge for use in an image forming apparatus such as a laser beam printer, multifunctional machine or the like and an image forming apparatus using this cartridge, in particular relating to a toner cartridge for storing toner such as a replaceable toner hopper, toner bottle, etc., as well as relating to an image forming apparatus using the cartridge.

(2) Description of the Prior Art

Conventionally, image forming apparatuses using static electrophotography usually include the steps of charging, exposure, development, transfer, separation, cleaning, charge erasing, fixing and the like.

In an image forming apparatus thus configured, the process for image forming is achieved as follows. That is, the surface of a photoreceptor that is rotationally driven is uniformly electrified by a charging device (charging step). Then, the photoreceptor surface thus electrified is illuminated with a laser beam from an exposure device to form an electrostatic latent image (exposure step). Subsequently, the electrostatic latent image on the photoreceptor is developed by a developing device to form a toner image on the photoreceptor surface (developing step). The toner image on the photoreceptor is transferred to a transfer medium by a transfer device (transfer step), then the toner image is heated by a fixing device and fixed to the transfer medium (fixing step). On the other hand, the residual toner remaining on the photoreceptor drum surface after the transfer step is removed by a cleaning device and collected into a predetermined collecting portion (cleaning step). The photoreceptor surface after cleaning is cleared of residual charge by a charge erasing device to prepare for a next image forming operation (charge erasing step).

As the developer for developing the electrostatic latent image on the photoreceptor, a mono-component developer consisting of a toner only or a dual-component developer consisting of a toner and a carrier is usually used.

Since a mono-component developer does not include any carrier, there is no need to have an agitating mechanism for mixing toner and carrier uniformly. Hence the developing device has the advantage of a simple structure. However, there is a drawback that the amount of static charge on the toner is unlikely to be stable.

On the other hand, since a dual-component developer needs to have an agitating mechanism for mixing the toner and carrier uniformly, there is a drawback that the developing device is complex. However, since the developer presents stable toner charging performance and suitability to high-speed machines, it is often used for high-speed image forming apparatuses and color image forming apparatuses.

Recently, in order to meet the demands of the users for energy saving and high-quality image printing, micro toners having a low softening temperature and a volume mean diameter as low as 5 to 9 μm have become used.

Though the toner of this kind is designed to be able to be fixed at low temperatures and is effective in enhancing resolution and reducing granulation to achieve improved image quality, the toner is low in fluidity so that there occurs the problem that it is difficult to control the amount of toner supplied from the toner cartridge to the developing device.

Particularly, there are some configurations in which external additives are added in order to improve the fluidity of the toner. In such a case, however, when a sponge-formed supply roller is used as the toner discharging member for the toner cartridge, the external additives become embedded into the toner particles due to friction between the toner and the sponge-formed supply roller, causing the problem that the fluidity becomes extremely lowered.

As the prior technology to deal with this problem, there has been a disclosed conventional configuration in which a screw-formed agitating and conveying member is used to perform toner supply (see patent document 1: Japanese Patent Application Laid-open 2001-83802). As another disclosure, there has been a configuration in which a screw-formed toner discharging member is used instead of a spongy-formed supply roller so as to reduce friction between the toner and the supplying member during toner supply (see patent document; Japanese Patent Application Laid-open 2008-216360).

However, when the toner that is low in fluidity after having been left for long time under a high temperature environment is conveyed and agitating by rotating a screw-formed toner discharging member as described in patent document 1, the toner is compressed without being discharged from the toner discharge port, causing the problem that the toner discharging member becomes stuck (or referred to as 'locked' hereinbelow).

SUMMARY OF THE TECHNOLOGY

The present technology has been devised in view of the above conventional problem, it is therefore an object of the present technology to provide a toner cartridge that can prevent the toner discharging member in the toner cartridge from being locked so as to achieve stable toner supply as well as to provide an image forming apparatus using the same toner cartridge.

The toner cartridge according to the present technology for solving the above problem and the image forming apparatus using this toner cartridge are configured as follows:

The first aspect of the present technology resides in a toner cartridge comprising: a toner storing portion for storing toner; a toner discharging portion having a toner discharge port; and, a toner conveying screw having a rotary shaft and a helical blade for conveying the toner in the toner storing portion to the toner discharging portion, and is characterized in that the helical blade includes a first helical blade portion located over the toner discharge port and a second helical blade portion located in the toner storing portion, the first toner thrust face of the first helical blade portion, located on the downstream side with respect to the toner conveying direction is formed at a first inclination angle to the axial direction of the rotary shaft, the second toner thrust face of the second helical blade portion, located on the downstream side with respect to the toner conveying direction is formed at a second inclination angle to the axial direction of the rotary shaft, and the first inclination angle is formed to be smaller than the second inclination angle.

It is also preferable in the second aspect of the present technology that the upstream side face of the first helical blade portion with respect to the toner conveying direction (the rear face of the first toner thrust face) is formed at a third inclination angle to the axial direction of the rotary shaft that is located on the downstream side with respect to the toner conveying direction, and the third inclination angle is greater than 90 degrees.

Further, it is preferable in the third aspect of the present technology that the first helical pitch of the first helical blade portion is greater than the second helical pitch of the second helical blade portion.

The fourth aspect of the present technology resides in an image forming apparatus for forming images with toner based on electrophotography, comprising: a photoreceptor drum for forming an electrostatic latent image on the surface thereof; a developing unit for forming a toner image by supplying toner to the electrostatic latent image on the surface of the photoreceptor drum; a toner cartridge for supplying toner to the developing unit through a toner supply part; a transfer device for transferring the toner image on the photoreceptor drum surface to a recording medium; and, a fixing device for fixing the transferred toner image to the recording medium, and is characterized in that the toner cartridge defined in any one of the above first to third features is used as the toner cartridge.

According to the first aspect of the present technology, since the first inclination angle of the first toner thrust face located over the toner discharge port is formed to be gentle, of the force that acts from the first toner thrust face on toner (the force the toner receives) as the toner conveying screw rotates, the component force in the axial direction of the toner conveying screw (the force that serves to convey the toner) is weakened while the force that thrusts the toner toward the inner peripheral wall of the toner discharging portion with the toner discharge port therein is increased. As a result, the toner becomes unlikely to be compressed in the axial direction of the toner conveying screw and at the same time, becomes ready to be discharged from the toner discharge port. Consequently, it is possible to prevent the toner conveying screw from being locked due to compressed toner.

According to the second aspect of the present technology, since an acute-angled depressed space (low-pressure zone) is formed between the rear face side of the first toner thrust face over the toner discharge port, provision of this space makes it possible to alleviate the force of compressing the toner resulting from the thrust force of the conveying helical blade located on the upstream side with respect to the toner conveying direction, hence prevent the toner from being compressed.

According to the third aspect of the present technology, since the conveying distance by which toner is conveyed while the toner conveying screw makes one revolution becomes longer in the region over the toner discharge port than inside the toner storing portion, the amount of toner per unit volume is reduced so that it is possible to alleviate the force of compressing the toner resulting from the thrust force of the conveying helical blade and prevent the toner from being compressed.

According to the fourth aspect of the present technology, since it is possible to eliminate the risk of the toner around the toner discharge port through which toner inside the toner cartridge is discharged, being compressed by the pressure of the toner conveying screw that conveys the toner, and hence prevent the toner conveying screw from being locked due to toner solidification, it is possible to achieve a reliable toner supply operation. This makes it possible to obtain a predetermined toner concentration and hence realize high-quality image output in a stable manner.

DESCRIPTION OF THE PREFERRED EMBODIMENTS

Now, the mode for carrying out the present technology will be described with reference to the drawings.

Figure 1:
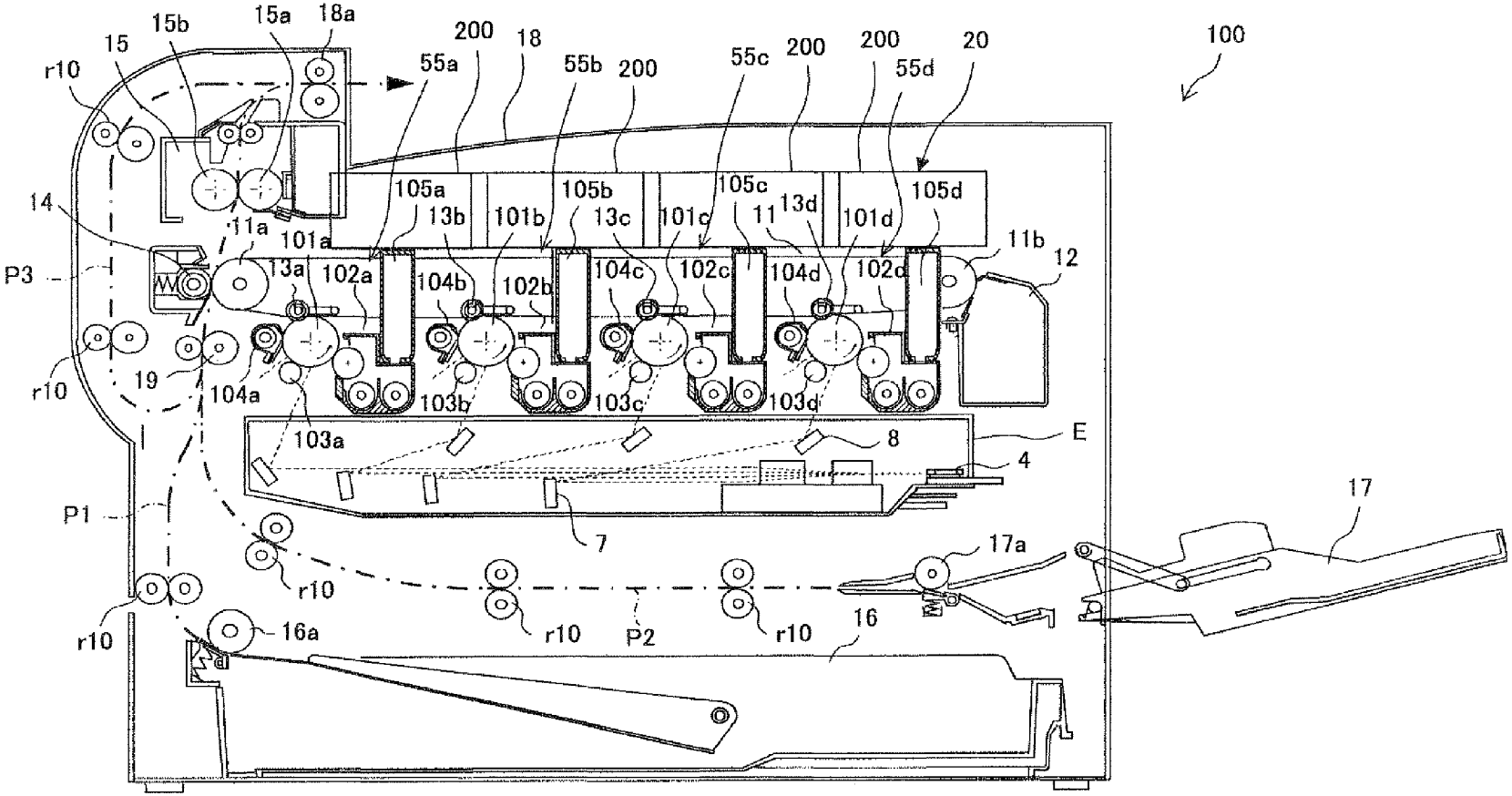
FIG. 1 is an illustrative view showing the overall configuration of an image forming apparatus in which a toner cartridge according to the embodiment of the present technology is used.

FIG. 1 shows one exemplary embodiment of the present technology, and is an illustrative view showing the overall configuration of an image forming apparatus in which a toner cartridge according to the embodiment of the present technology is used.

An image forming apparatus 100 according to the present embodiment forms an image with toners based on electrophotography, including: as shown in FIG. 1, photoreceptor drums 101*a*, 101*b*, 101*c* and 101*d* (which may also be called "photoreceptor drums 101" when general mention is made) for forming electrostatic latent images on the surfaces thereof; developing units 102*a*, 102*b*, 102*c* and 102*d* (which may also be called "developing units 102" when general mention is made) that supply toners to respective electrostatic latent images on photoreceptor drum 101 surfaces to form toner images; toner cartridges 200 which supply toner to developing units 102 through toner supply pipes 105*a*, 105*b*, 105*c* and 105*d* (which may also be called "toner supply pipes 105" when general mention is made); a secondary transfer roller (transfer device) 14 for transferring the toner images on photoreceptor drum 101 surfaces to the paper by way of an intermediate transfer belt 11; and a fixing unit 15 for fixing the transferred toner image to the paper.

To being with, the overall configuration of image forming apparatus 100 according to the present embodiment will be described.

Image forming apparatus 100 of the present embodiment forms a visual image printout of a multi-colored or monochrome image on a predetermined sheet (recording paper) in accordance with image data contained in an input command, such as image data and the like transmitted from the outside by way of a communication network or the like.

This image forming apparatus 100 includes: as shown in FIG. 1, an exposure unit E; photoreceptor drums 101 (101*a* to 101*d*) corresponding to image bearers on which latent images are formed by the exposure unit E; developing units 102 (102*a* to 102*d*); charging rollers 103*a* to 103*d* (which may also be called "charging rollers 103" when general mention is made); cleaning units 104*a* to 104*d* (which may also be called "cleaning units 104" when general mention is made); intermediate transfer belt 11; primary transfer rollers 13*a* to 13*d* (which may also be called "primary transfer rollers 13" when general mention is made); secondary transfer roller 14; fixing unit 15; paper feed paths P1, P2 and P3; a paper feed cassette 16; a manual paper feed tray 17; a paper output tray 18; and a toner cartridge unit 20.

The image data for color images handled in this image forming apparatus 100 is formed of image data of four colors, i.e., black (K), cyan (C), magenta (M) and yellow (Y), and each of image forming portions 55*a* to 55*d* (which may also be called "image forming portions 55" when general mention is made) forms a visual image with toner of a color that corresponds to the color image data.

Accordingly, four developing units 102 (102*a* to 102*d*), four photoreceptor drums 101 (101*a* to 101*d*), four charging rollers 103 (103*a* to 103*d*) and four cleaning units 104 (104*a* to 104*d*) are provided so as to form four latent images corresponding to four different colors.

All the image forming portions 55*a* to 55*d* have the same configurations, for example black image forming portion 55*a* is composed of photoreceptor drum 101*a*, developing unit 102*a*, charging roller 103*a*, transfer roller 13*a* and cleaning unit 104*a* and the like. These image forming portions 55*a* to 55*d* are arranged side by side in the moving direction of intermediate transfer belt 11 (in the sub scan direction).

Here, the symbols a to dare used so that 'a' corresponds to black, 'b' to cyan, 'c' to magenta and 'd' to yellow. The devices designated by each symbol form one imaging station, that is, four imaging stations are provided.

Exposure unit E as the light exposure device in the present embodiment includes an unillustrated semiconductor laser, a polygon mirror 4, a first reflecting mirror 7 and a second reflecting mirror 8, and illuminates photoreceptor drums 101*a* to 101*d* with light beams, i.e., laser beams, that are modulated based on image data of separate colors, that is, black, cyan, magenta and yellow.

Formed on photoreceptor drums 101*a* to 101*d* are electrostatic latent images based on image data of respective colors of black, cyan, magenta and yellow.

Though exposure unit E of the present embodiment is based on a technique using a laser scanning unit (LSU) equipped with a laser emitter and reflection mirrors, other methods using an array of light emitting elements such as an EL or LED writing head, for example may be used instead.

Photoreceptor drum 101 is an essentially cylindrical image bearer, which is arranged above exposure unit E, and is controlled by an unillustrated driving device and control device so as to rotate in a predetermined direction.

Photoreceptor drum 101 is composed of a base member and a photoconductive layer formed thereon. For example, the photoreceptor drum may be formed of a metallic base drum of aluminum or the like and a thin film of a photo conductive layer of amorphous silicon (a-Si), selenium (Se), organic photoconductor (OPC) or the like, formed on the outer peripheral surface of the base member. The configuration of photoreceptor drum 101 is not particularly limited to the above.

Charging roller 103 is a charging device of a contact type which uniformly electrifies the photoreceptor drum 101 surface at a predetermined potential. In the present embodiment, contact roller-type charging roller 103 is used as a charger as shown in FIG. 1, a charger of a corona discharging type or a brush type may be used instead of charging roller 103.

Developing unit 102 supplies toner to the photoreceptor drum 101 surface with an electrostatic latent image formed thereon to develop the electrostatic latent image into a toner image. Developing units 102*a* to 102*d* store black, cyan, magenta and yellow color toners, respectively so as to develop the electrostatic latent images for individual colors formed on photoreceptor drums 101*a* to 101*d* into toner images of black, cyan, magenta and yellow colors.

Cleaning unit 104 removes and collects the toner remaining on the photoreceptor drum 101 surface after development and image transfer, using a lubricant or the like.

Intermediate transfer belt 11 is arranged over photoreceptor drums 101 and formed of an endless film having a thickness of about 100 to 150 μm. This belt is wound and tensioned between a drive roller 11*a* and a driven roller 11*b*, forming a loop-like moving path.

Arranged opposing the outer peripheral surface of intermediate transfer belt 11 are photoreceptor drum 101*d*, photoreceptor drum 101*c*, photoreceptor drum 101*b* and photoreceptor drum 101*a* in the order mentioned.

Primary transfer rollers 13*a* to 13*d* are arranged at positions opposing respective photoreceptor drums 101*a* to 101*d* with this intermediate transfer belt 11 held therebetween. The areas where intermediate transfer belt 11 opposes photoreceptor drums 101*a* to 101*d* form respective primary transfer positions.

In order to transfer the toner images carried on the surfaces of photoreceptor drums 101*a* to 101*d* to intermediate transfer belt 11, each of primary transfer rollers 13*a* to 13*d* is applied by constant-voltage control at a primary transfer bias that has the opposite polarity to that of the static charge on the toner. With this arrangement, the toner images of individual colors formed on photoreceptor drums 101 (101*a* to 101*d*) are successively transferred one over the other to the outer peripheral surface of intermediate transfer belt 11 so that a full-color toner image is formed on the outer peripheral surface of intermediate transfer belt 11.

If image data involving only part of colors of yellow, magenta, cyan and black is input, among the four photoreceptor drums 101*a* to 101*d*, electrostatic latent images and hence toner images are formed only for the photoreceptor drums 101 that correspond to the colors of the input image data. For example, upon monochrome image forming, the electrostatic latent image and toner image for photoreceptor drum 101*a* corresponding to black color is formed, so that the black toner image alone is transferred to the outer peripheral surface of intermediate transfer belt 11.

Each of primary transfer rollers 13*a* to 13*d* is composed of a shaft formed of metal (e.g., stainless steel) having a diameter of 8 to 10 mm and a conductive elastic material (e.g., EPDM, foamed urethane, etc.) coated on the shaft surface, and uniformly applies a high voltage to intermediate transfer belt 11 through the conducive elastic material. Though in the present embodiment, primary transfer rollers 13*a* to 13*d* are used as the transfer electrodes, brushes and the like can also be used in their place.

The toner image transferred to the outer peripheral surface of intermediate transfer belt 11 at each primary transfer position is conveyed as intermediate transfer belt 11 circulates to the secondary transfer station where the belt opposes secondary transfer roller 14.

During image forming, secondary transfer roller 14 is abutted with a predetermined nip pressure against the outer peripheral surface of intermediate transfer belt 11, in the area where the interior side of intermediate transfer belt 11 is supported by drive roller 11*a*. In order to make the nip pressure constant, either secondary transfer roller 14 or intermediate transfer belt drive roller 11*a* is formed of a hard material such as metal or the like while the other is formed of a soft material such as an elastic roller or the like (elastic rubber roller, foamed resin roller etc.).

When the paper fed from paper feed cassette 16 or manual paper feed tray 17 passes through the nip between secondary transfer roller 14 and intermediate transfer belt 11, a high voltage of a polarity (+) opposite to the polarity (−) of the static charge on the toner is applied to secondary transfer roller 14.

In this way, the electrostatic latent images formed on photoreceptor drums 101 (101*a* to 101*d*) are visualized with the corresponding color toners, forming respective toner images, which are transferred to intermediate transfer belt 11 in a layered manner. Then the thus layered toner image is moved as intermediate transfer belt 11 circulates to the contact position between the paper being conveyed and intermediate transfer belt 11, so that the toner image is transferred from the outer peripheral surface of intermediate transfer belt 11 to the paper by means of secondary transfer roller 14.

Since, of the toner adhering to intermediate transfer belt 11 as the belt comes in contact with photoreceptor drums 101, the toner which has not been transferred from intermediate transfer belt 11 to the paper during transfer of the toner image and remains on intermediate transfer belt 11 would cause contamination of color toners at the next operation, it is removed and collected by an intermediate transfer belt cleaning unit 12.

Intermediate transfer belt cleaning unit 12 includes a cleaning blade, for example as a cleaning member that comes into contact with intermediate transfer belt 11. Intermediate transfer belt 11 is supported from its interior side by intermediate transfer belt driven roller 11*b*, at the portion where this cleaning blade is put in contact with intermediate transfer belt 11.

The paper with the toner image as a visual image transferred thereon is led to fixing unit 15 having a heat roller 15*a* and a pressing roller 15*b* and undergoes heating and pressing processes while passing through and between heat roller 15*a* and pressing roller 15*b*. Thereby, the toner image as a visual image is firmly fixed to the paper surface. The paper with the toner image fixed thereon is discharged by a paper discharge roller 18*a* onto paper output tray 18.

Image forming apparatus 100 includes a paper feed path P1 that extends approximately vertically to convey the paper stored in paper feed cassette 16 to paper output tray 18 by way of the nip between secondary transfer roller 14 and intermediate transfer belt 11 and fixing unit 15.

Arranged along paper feed path P1 are a pickup roller 16*a* for delivering the paper from paper feed cassette 16, one sheet at a time, into paper feed path P1, conveying rollers r10 for conveying the delivered paper upwards, a registration roller 19 for leading the conveyed paper to the nip between secondary transfer roller 14 and intermediate transfer belt 11 at a predetermined timing, and paper discharge roller 18*a* for discharging the paper to paper output tray 18.

Image forming apparatus 100 also incorporates a paper feed path P2 that extends from manual paper feed tray 17 to registration roller 19, having a pickup roller 17*a* and conveying rollers r10 arranged therealong. There is also another paper feed path P3 that extends from paper discharge roller 18*a* toward the upstream side of registration roller 19 in paper feed path P1.

Paper discharge roller 18*a* is adapted to be rotatable in both forward and reverse directions, and is rotated in the forward direction to discharge the paper to paper output tray 18 at the time of one-sided image forming for forming an image on one side of the paper and at the time of the second side image forming in duplex image forming for forming images on both sides.

On the other hand, at the time of the first side image forming in duplex image forming, paper discharge roller 18*a* is driven in the forward direction until the rear end of the paper passes by fixing unit 15 and then rotated in reverse while the roller is holding the rear end of the paper to lead the paper into paper feed path P3. Thereby, the paper with an image formed on the first side only during duplex image forming is led to paper feed path P1 with its printed face down and its front edge inverted to the rear.

Registration roller 19 leads the paper that has been fed from paper feed cassette 16 or manual paper feed tray 17 or that has been conveyed through paper feed path P3, to the nip between secondary transfer roller 14 and intermediate transfer belt 11 at a timing synchronized with the rotation of intermediate transfer belt 11. For this purpose, registration roller 19 stops rotating when photoreceptor drums 101 and intermediate transfer belt 11 start to operate while the paper that was started to be fed or conveyed in advance of rotation of intermediate transfer belt 11 is stopped from moving in paper feed path P1 with its front end abutting against registration roller 19.

Thereafter, registration roller 19 starts to rotate at such a timing that the front edge of the paper and the front end of the toner image formed on intermediate transfer belt 11 meet each other at the position where secondary transfer roller 14 and intermediate transfer belt 11 come in press-contact with each other.

Here, when full-color image forming is performed using all the image forming portions 55*a* to 55*d*, primary transfer rollers 13*a* to 13*d* are adapted to abut intermediate transfer belt 11 against respective photoreceptor drums 101*a* to 101*d*.

On the other hand, when monochrome image forming is performed with image forming portion 55*a* alone, primary transfer roller 13*a* alone is adapted to abut intermediate transfer belt 11 against photoreceptor drum 101*a*.

Next, the configuration of toner cartridge 200 will be described in detail with reference to the drawings.

Figure 2:
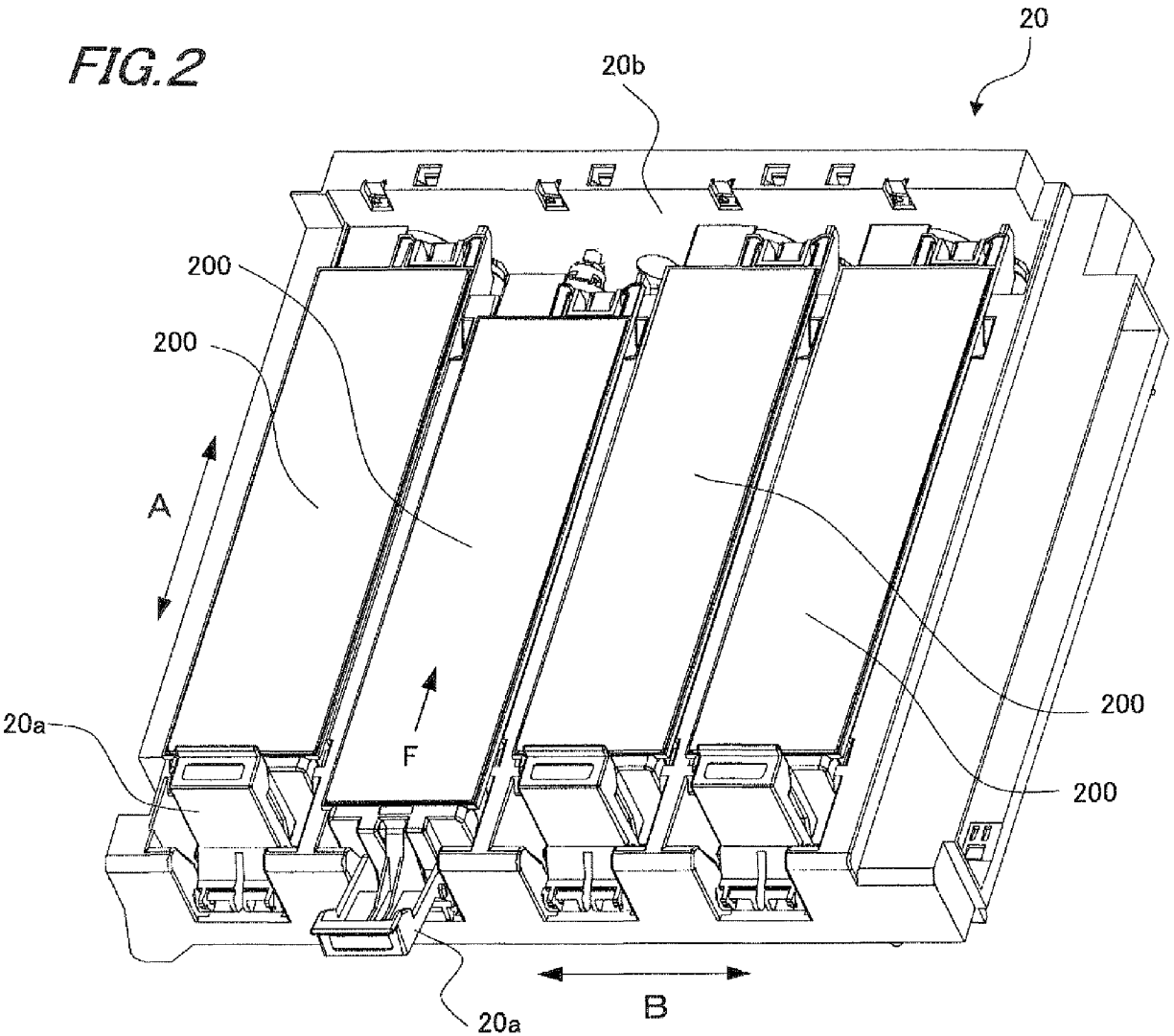
FIG. 2 is a perspective view showing the configuration of a toner cartridge unit including toner cartridges mounted in the image forming apparatus.
Figure 3A:
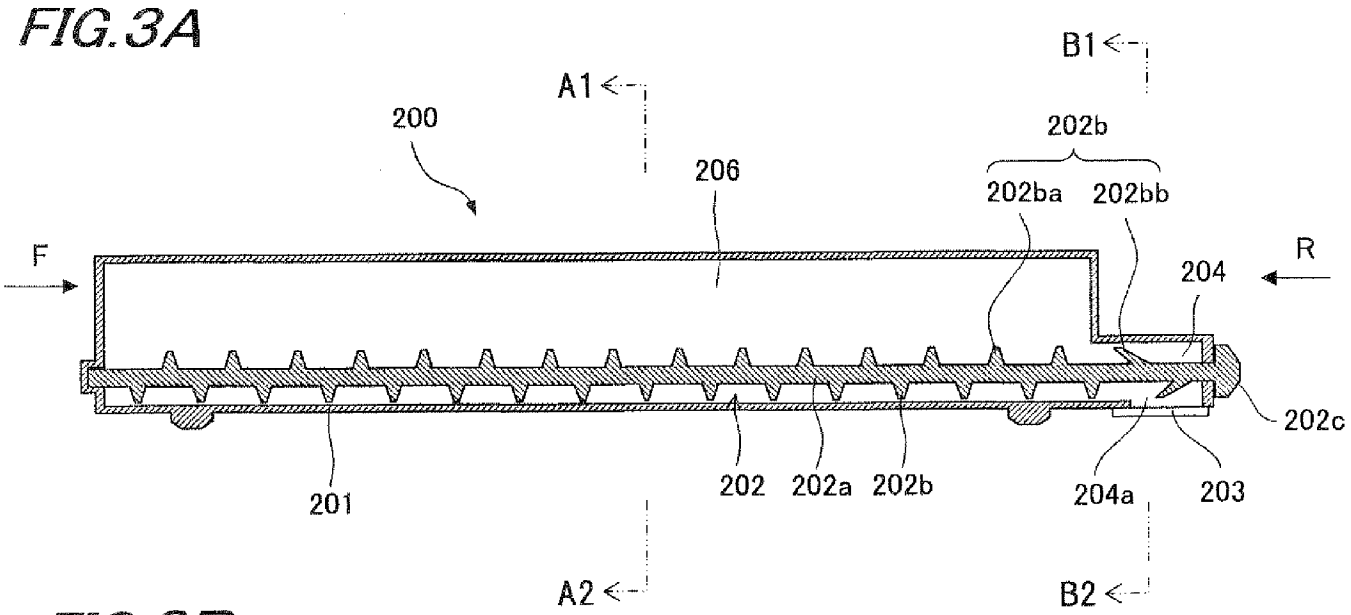
FIG. 3A is a sectional side view showing the configuration of the toner cartridge.
Figure 3C:
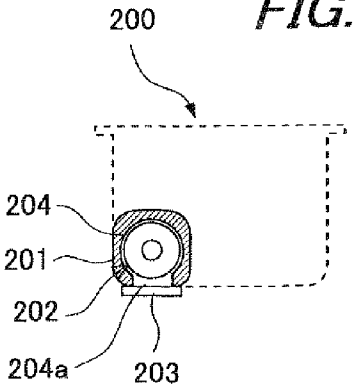
FIG. 3C is a sectional view cut along a plane B1-B2 in FIG. 3A.
Figure 3B:
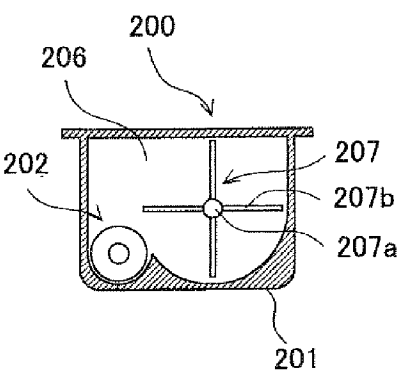
FIG. 3B is a sectional view cut along a plane A1-A2 in FIG. 3A.
Figure 4:
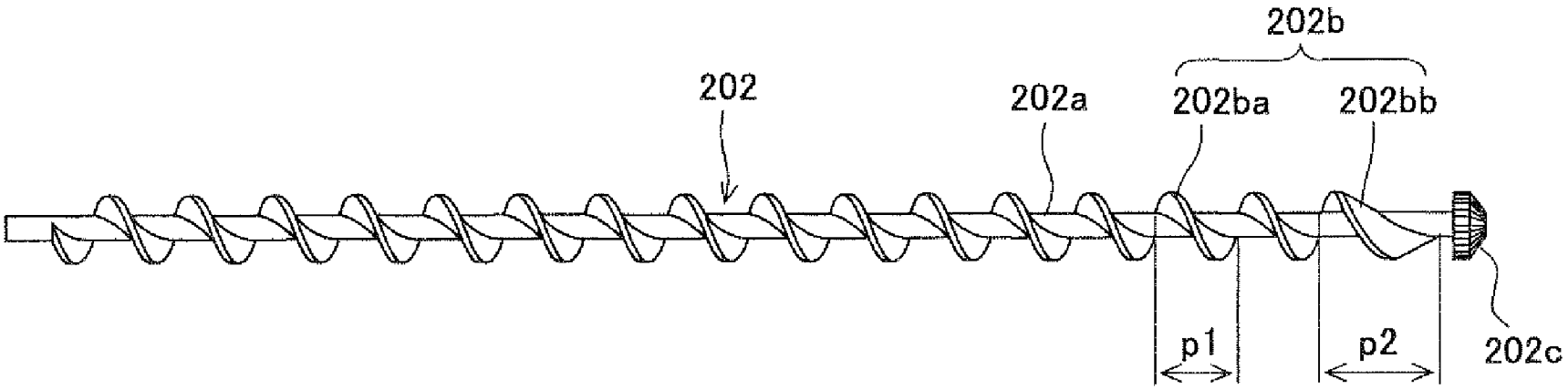
FIG. 4 is a side view showing the configuration of a screw auger that constitutes the toner cartridge.
Figure 5:
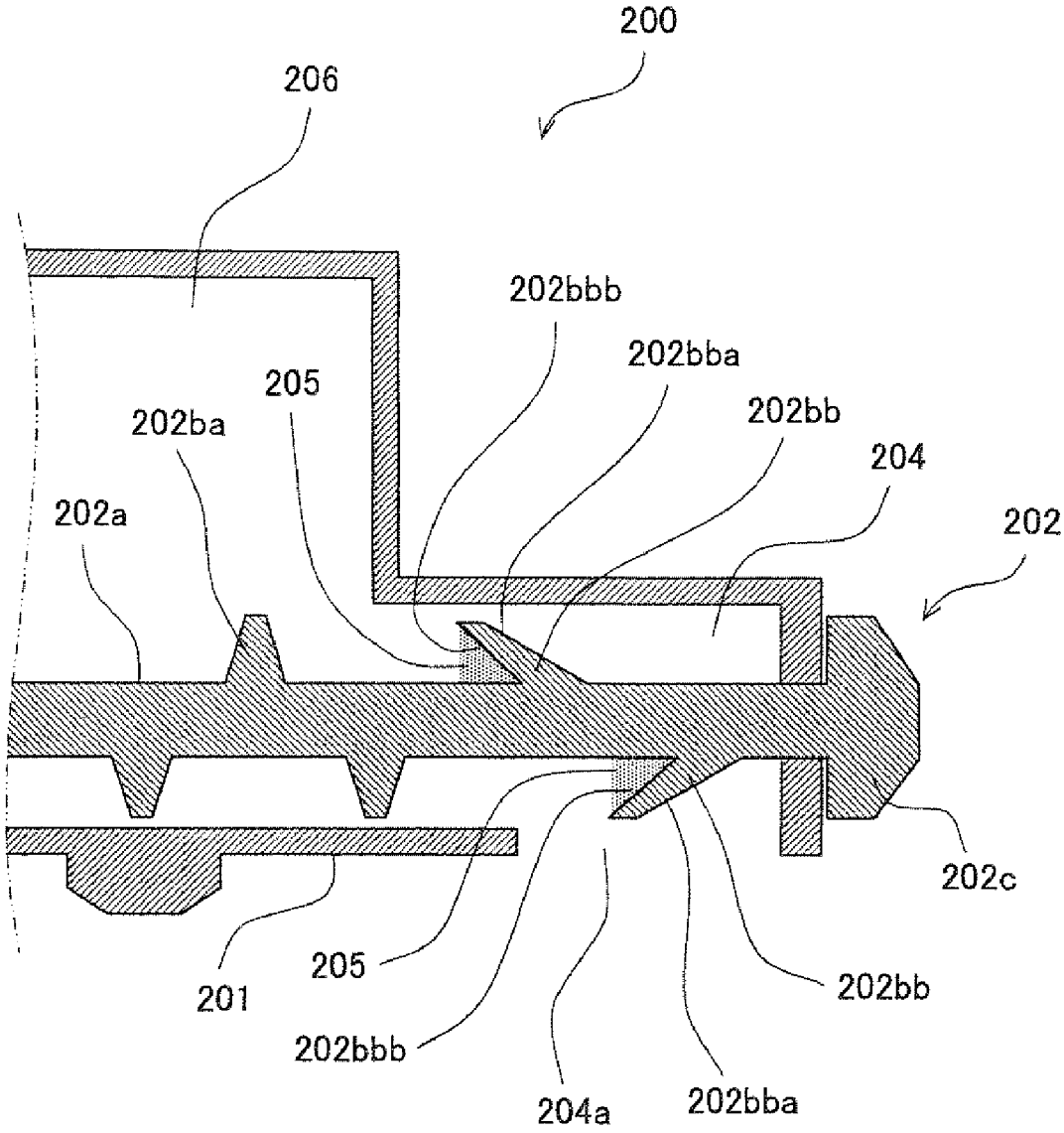
FIG. 5 is a partial detailed view showing the configuration of a helical blade that is disposed at the toner discharging portion of the toner cartridge.
Figure 6A:
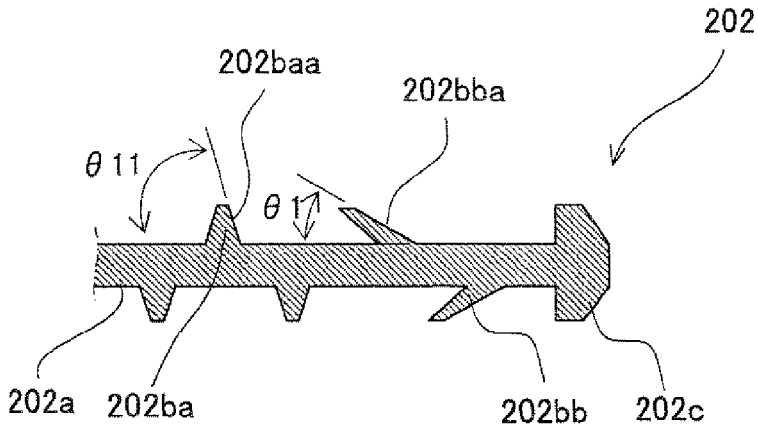
FIG. 6A is an illustrative view showing the inclination angle of the downstream face of the helical blade with respect to the toner conveying direction.
Figure 6B:
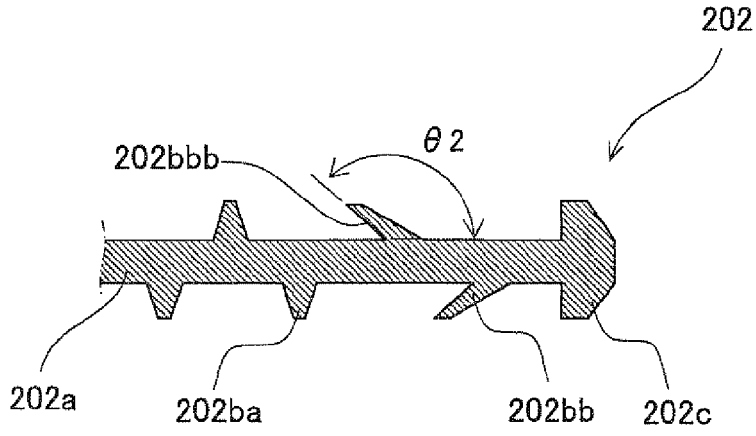
FIG. 6B is an illustrative view showing the inclination angle of the upstream face of the helical blade with respect to the toner conveying direction; and, FIG. 7 is an illustrative view showing the components of the force acting on the toner from the toner thrust face of the helical blade of the screw auger.

FIG. 2 is a perspective view showing the configuration of the toner cartridge unit including toner cartridges mounted in the image forming apparatus according to the present embodiment. FIG. 3A is a sectional side view showing the configuration of the toner cartridge. FIG. 3B is a sectional view cut along a plane A1-A2 in FIG. 3A. FIG. 3C is a sectional view cut along a plane B1-B2 in FIG. 3A. FIG. 4 is a side view showing the configuration of a screw auger that constitutes the toner cartridge. FIG. 5 is a partial detailed view showing the configuration of a helical blade that is disposed at the toner discharging portion of the toner cartridge. FIG. 6A is an illustrative view showing the inclination angle of the downstream face of the helical blade with respect to the toner conveying direction. FIG. 6B is an illustrative view showing the inclination angle of the upstream face of the helical blade with respect to the toner conveying direction.

As shown in FIG. 1, toner cartridge 200 according to the present embodiment is mounted to toner cartridge unit 20 provided in image forming apparatus 100.

Provided on the main body side of image forming apparatus 100 are a plurality of toner supply pipes (toner supply parts) 105 for leading the toner discharged from toner cartridges 200. Toner supply pipe 105 is arranged at such a position as to oppose an aftermentioned toner discharge port 204*a* of toner cartridge 200 when toner cartridge 200 has been mounted in toner cartridge unit 20.

Here, in the present embodiment, developing unit 102 is arranged under toner supply pipe 105 so that toner is supplied to developing unit 102 through the toner supply pipe 105. The toner supply pipes 105 are positioned outside intermediate transfer belt 11 with respect to the width direction of intermediate transfer belt 11.

As shown in FIG. 2, toner cartridge unit 20 is provided in a top-open box form, in which four toner cartridges 200 including four color toners, i.e. black (K), cyan (C), magenta (M) and yellow (Y) toners, respectively are accommodated.

Each toner cartridge 200 is formed to be long along the intermediate transfer belt's width direction (the direction of arrow A). These toner cartridges are disposed side by side along the intermediate transfer belt's direction of conveyance (the direction of arrow B) at respective positions opposing developing units 102 (102*a* to 102*d*).

Toner cartridge unit 20 includes a stopper plate 20*b* disposed along one side that extends in the intermediate transfer belt's direction of conveyance so as to position toner cartridges 200, and lock levers 20*a* disposed on the opposite side to shift respective toner cartridges 200 toward stopper plate 20*b* side and hold them.

Lock lever 20*a* is laid down sideward when toner cartridge 200 is simply put. To mount toner cartridge 200 into toner cartridge unit 20 in a usable manner, lock lever 20*a* is set upright so as to move toner cartridge 200 in the direction of arrow F and hold the toner cartridge by its being abutted against stopper plate 20*b*.

As shown in FIGS. 3A, 3B and 3C, toner cartridge 200 includes a toner container (toner storing portion) 201 for storing toner, a screw auger (toner conveying screw) 202, toner discharge port 204*a*, a shutter 203 and an agitating paddle 207. Here, symbols 'F' and 'R' in FIG. 3A designate the positional relationship for attachment of toner cartridge 200 in image forming apparatus 100, 'F' representing the near side (control side) of image forming apparatus 100 and 'R' the far side of image forming apparatus 100.

As shown in FIG. 3A, toner container 201 includes a toner storing portion 206 that defines a box-shaped space having an approximately rectangular vertical section for storing toner therein. In one longitudinal end of the container, a toner discharging portion 204 having a toner discharge port 204*a* is projectively formed outside from toner storing portion 206.

As shown in FIG. 3C, toner discharging portion 204 is formed by an approximately cylindrical form with an interior space having a round vertical section. Inside toner storing portion 206, screw auger 202 and agitating paddle 207 are rotatably supported parallel to each other, as shown in FIG. 3B.

As shown in FIGS. 3A and 4, screw auger 202 includes a rotary shaft 202*a*, a helical blade 202*b* and a drive gear 202*c*. This screw auger 202 is disposed in the bottom of toner container 201, extending from toner storing portion 206 to toner discharging portion 204. That is, screw auger 202 is located above toner discharge port 204*a*. The direction in which the axis of the rotary shaft 202*a* extends may be written briefly as the axial direction hereinbelow.

Helical blade 202*b* turns so as to convey the toner inside toner container 201 toward toner discharge port 204*a*.

Drive gear 202*c* is projectively arranged outside toner discharging portion 204 so that drive force from an unillustrated motor provided for the image forming apparatus body is transferred thereto.

As shown in FIG. 3B, agitating paddle 207 is an agitating member made up of a rotary shaft 207*a* disposed approximately parallel to screw auger 202 and four agitating blades 207*b* provided equi-angularly around the rotary shaft 207*a* along the axis thereof. With this arrangement, the toner in toner storing portion 206 can be loosen up as agitating blades 207*b* rotate.

Toner discharge port 204*a* is rectangularly opened in the bottom of the peripheral wall of toner discharging portion 204 and discharges the toner conveyed by screw auger 202 out of toner cartridge 200.

Shutter 203 is a shutter member that is formed of an approximately rectangular plate-like piece that opens and closes toner discharge port 204*a*, and is arranged under, and on the outer side of, toner container 201 so as to be slidable in the longitudinal direction of toner container 201. In the usual state, the shutter is urged by an unillustrated spring member or the like to the position that confines the toner discharge port 204*a*. When toner cartridge 200 has been mounted to image forming apparatus 100, this shutter releases toner discharge port 204*a* in linkage with the attachment action of toner cartridge 200.

That is, when toner cartridge 200 is mounted into toner cartridge unit 20, shutter 203 moves in an approximately horizontal direction as toner container 201 moves in an approximately horizontal direction relative to toner supply pipe 105. Then, when the toner cartridge has been set at the position where toner discharge port 204*a* opposes toner supply pipe 105, the toner discharge port 204*a* is released so that toner can be supplied from the top of toner supply pipe 105.

Now, the configuration of helical blade 202*b* of screw auger 202 will be described in detail with reference to the drawings.

As shown in FIGS. 3A, 4 and 5, helical blade 202*b* includes conveying helical blade 202*ba* (the second helical blade portion) having a trapezoidal section and a discharging helical blade 202*bb* (the first helical blade portion) having an approximately parallelogrammic section.

Conveying helical blade 202*ba* is provided inside toner storing portion 206. Discharging helical blade 202*bb* is provided inside toner discharging portion 204.

Discharging helical blade 202*bb* has a toner thrust face that provides the function of thrusting toner (the face on the downstream side with respect to the toner conveying direction: the first toner thrust face) 202*bba* and the rear face of toner thrust face 202*bba* (the face on the upstream side with respect to the toner conveying direction) 202*bbb*, as shown in FIGS. 6A and 6B.

As shown in FIG. 6A, toner thrust face 202*bba* is formed so as to have an inclined angle θ1 (the first inclination angle) relative to the axial direction of rotary shaft 202*a*. More specifically, toner thrust face 202*bba* is formed so that the angle formed between toner thrust face 202*bba* and the axis of rotary shaft 202*a* extending to the upstream side in the toner conveying direction forms the inclination angle θ1.

That is, the inclination angle θ1 is the angle that is formed, in the vertical section, between toner thrust face 202*bba* and the surface of rotary shaft 202*a* that is connected to the rear face 202*bbb* on the upstream side with respect to the toner conveying direction (the rotary shaft surface on the upstream side with respect to the toner conveying direction).

As shown in FIG. 6B, the rear face 202*bbb* is formed so that the angle between rear face 202*bbb* and the axis extending to the downstream side from rear face 202*bbb* in the toner conveying direction forms the inclination angle θ2 (the third inclination angle). That is, the inclination angle θ2 is the angle that is formed, in the vertical section, between rear face 202*bbb* and the surface of rotary shaft 202*a* that is connected to the toner thrust face 202*bba* on the downstream side with respect to the toner conveying direction (the rotary shaft surface on the downstream side with respect to the toner conveying direction).

Further, rear face 202*bbb* is so formed that the angle of the axis of the rotary shaft 202*a* on the upstream side of rear face 202*bbb* with respect to the toner conveying direction differs from the inclination angle θ1.

In the present embodiment, the inclination angle θ1 is set to be not greater than 45° and the inclination angle θ2 is set to be not smaller than 135°.

The toner thrust face (the second toner thrust face) 202*baa* of conveying helical blade 202*ba* is formed so as to have an inclination angle θ11 (the second inclination angle) relative to the axial direction of rotary shaft 202*a*, as shown in FIG. 6A. More specifically, toner thrust face 202*baa* is formed so that the angle formed between toner thrust face 202*baa* and the axis of rotary shaft 202*a* extending to the upstream side in the toner conveying direction forms the inclination angle θ11.

That is, the inclination angle θ11 is the angle that is formed, in the vertical section, between toner thrust face 202*baa* and the surface of rotary shaft 202*a* that is connected to the rear face of toner thrust face 202*baa* on the upstream side with respect to the toner conveying direction (the rotary shaft surface on the upstream side with respect to the toner conveying direction).

As shown in FIG. 6A, the inclination angle θ1 is formed to be smaller than the inclination angle θ11.

When the inclination angle θ2 of rear face 202*bbb* of discharging helical blade 202*bb* is set to be greater than 90°, an acute-angled depressed low-pressure zone 205 is formed between rear face 202*bbb* and the aforementioned upstream side rotary shaft surface extending in the toner conveying direction.

Further, as shown in FIGS. 3A and 4, the helical pitch (the first helical pitch), designated at p2, of discharging helical blade 202*bb* arranged over the toner discharge port 204*a* is set to be greater than the helical pitch (the second helical pitch), designated at p1, of conveying helical blade 202*ba* arranged inside toner storing portion 206.

Here, the helical pitch (helical blade pitch) indicates the distance by which a contact point of helical blade 202*b* with rotary shaft 202*a* on a plane that passes through the axis of the rotary shaft advances in the direction in which the axis of rotary shaft 202*a* extends (which may be referred to as "the axial direction") while helical blade 202*b* rotates about rotary shaft 202*a* by one revolution.

With the above configuration, since the conveying distance by which toner is conveyed during one revolution of screw auger 202 is longer in the region over toner discharge port 204*a* than inside toner storing portion 206, the amount of toner per unit volume (toner density) in the helical pitch inside toner discharging portion 204 is reduced. Accordingly, it is possible to alleviate the force of compressing the toner resulting from the thrust force of conveying helical blade 202*ba* located on the upstream side with respect to the toner conveying direction, hence prevent the toner from being compressed in the region over toner discharge port 204*a*.

The toner cartridge 200 thus configured is arranged over developing unit 102 and coupled to toner supply pipe 105 so as to supply toner to developing unit 102, as shown in FIG. 1.

Next, the operation of screw auger 202 for conveying toner will be described in detail with reference to the drawings.

Figure 7:
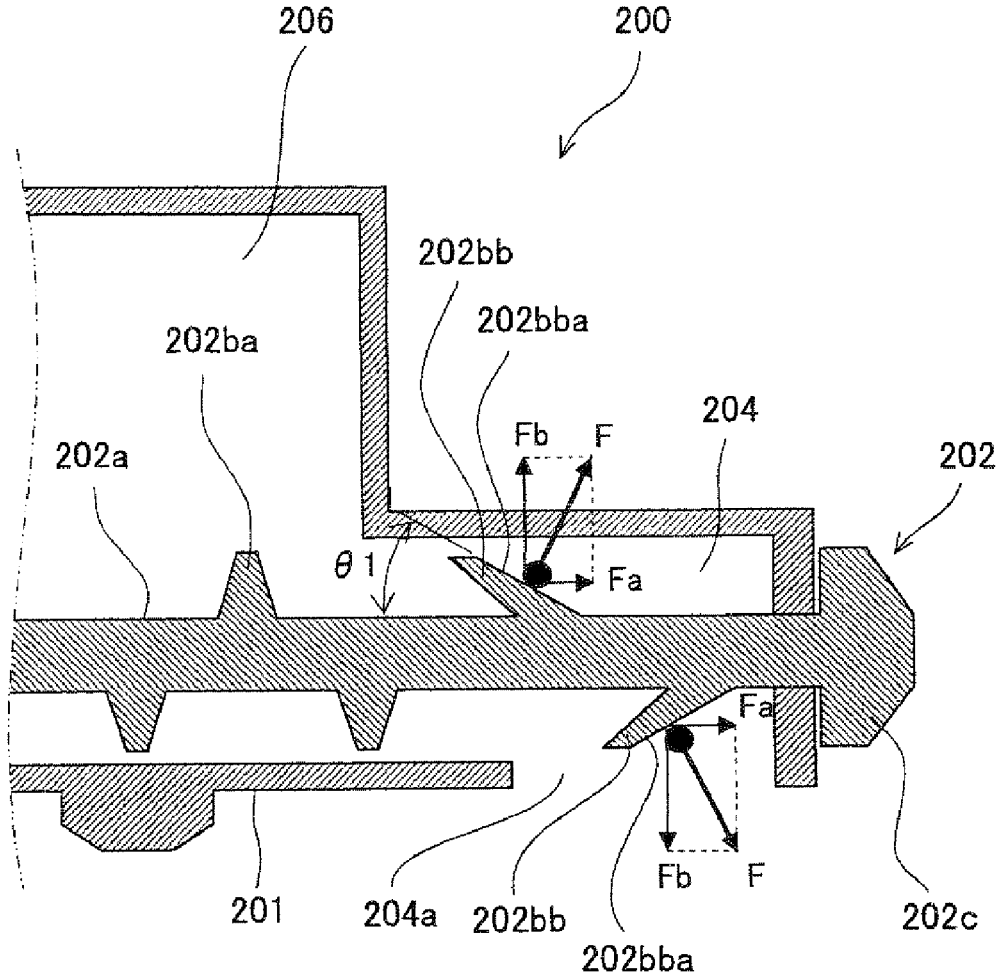

FIG. 7 is an illustrative view showing the components of the force acting on the toner from the toner thrust face of the helical blade of the screw auger according to the present embodiment.

The inclination angle θ1 of toner thrust face 202*bba* of discharging helical blade 202*bb* is formed gentle (not greater than 45°) as shown in FIG. 7. Accordingly, when the inclination angle θ1 is less than 45°, the force F acting on the toner from toner thrust face 202*bba* of discharging helical blade 202*bb* is composed of a component force Fa along the axial direction of rotary shaft 202*a* and a component force Fb along the radial direction of rotary shaft 202*a*, the latter being greater than the former. As a result, the toner conveyed into toner discharging portion 204 is pushed out toward the peripheral wall of toner discharging portion 204 in which toner discharge port 204*a* is provided. The same operation and effect can be obtained when the inclination angle θ1 is equal to 45°.

Further, since the inclination angle θ1 of discharging helical blade 202*bb* is formed to be smaller than the inclination angle θ11 of conveying helical blade 202*ba* as shown in FIG. 6A, the axial component force Fa acting on toner from toner thrust face 202*bba* of discharging helical blade 202*bb* is smaller than the axial component force from conveying helical blade 202*ba*. As a result, the toner that is conveyed in the axial direction of screw auger 202 is unlikely to be compressed inside toner discharging portion 204 and becomes ready to be discharged from toner discharge port 204*a*.

According to the present embodiment configured as above, helical blade 202*b* of screw auger 202 in toner cartridge 200 is formed of conveying helical blade 202*ba* arranged in toner storing portion 206 and discharging helical blade 202*bb* arranged over toner discharge port 204*a* while the inclination angle θ1 of toner thrust face 202*bba* of discharging helical blade 202*bb* to the axial direction of rotary shaft 202*a* is formed to be smaller than the inclination angle θ11 of toner thrust face 202*baa* of conveying helical blade 202*ba* to the axial direction of rotary shaft 202*a*. This configuration makes the toner being conveyed in the axial direction unlikely to be compressed and makes the toner ready to be discharged from toner discharge port 204*a*. As a result, it is possible to prevent screw auger 202 from being locked due to compressed toner.

Further, according to the present embodiment, setting the inclination angle θ1 formed between toner thrust face 202*bba* of discharging helical blade 202*bb* and rotary shaft 202*a* to be smaller than 45° and setting the inclination angle θ2 of rear face 202*bbb* of discharging helical blade 202*bb* to be greater than 90° make it possible to create low-pressure zone 205 on the rear face 202*bbb* side, it is hence possible to reduce the force of compressing toner resulting from the thrusting force of conveying helical blade 202*ba* by accepting toner in this space.

Further, according to the present embodiment, since the helical pitch p2 of discharging helical blade 202*bb* arranged inside toner discharging portion 204 is set to be greater than the helical pitch p1 of conveying helical blade 202*ba* arranged inside toner storing portion 206, the conveying distance by which toner is conveyed while screw auger 202 makes one revolution is longer in the region over toner discharge port 204*a* of toner discharging portion 204 than in toner storing portion 206. As a result, the amount of toner per unit volume is reduced so that it is possible to alleviate the force of compressing the toner resulting from the thrust force of conveying helical blade 202*ba* and prevent the toner from being compressed.

Though the above embodiment was described taking an example in which the image forming apparatus of the present technology is applied to image forming apparatus 100 shown in FIG. 1, the present technology can be developed to any other image forming apparatus and the like, not limited to the image forming apparatus described above as long as the image forming apparatus is constructed to supply toner to the developing unit using a toner cartridge. For example, the present technology can be applied to an image forming apparatus based on electrophotography that supports monochrome image forming only.

Having described heretofore, the present technology is not limited to the above embodiment, various changes can be made within the scope of the appended claims. That is, any embodied mode obtained by combination of technical means modified as appropriate without departing from the spirit and scope of the present technology should be included in the technical art of the present technology.

What is claimed is:

1. A toner cartridge comprising:

a toner storing portion for storing toner;

a toner discharging portion having a toner discharge port; and, a toner conveying screw having a rotary shaft and a helical blade for conveying the toner in the toner storing portion to the toner discharging portion, characterized in that the helical blade includes a first helical blade portion located over the toner discharge port and a second helical blade portion located in the toner storing portion, wherein a first helical pitch of the first helical blade portion is greater than a second helical pitch of the second helical blade portion, a first toner thrust face of the first helical blade portion, located on a downstream side with respect to a toner conveying direction is formed at a first inclination angle to an axial direction of the rotary shaft, a second toner thrust face of the second helical blade portion, located on a downstream side with respect to the toner conveying direction is formed at a second inclination angle to the axial direction of the rotary shaft, and the first inclination angle is formed to be smaller than the second inclination angle.

2. The toner cartridge according to claim 1, wherein an upstream side face of the first helical blade portion with respect to the toner conveying direction is formed at a third inclination angle to the axial direction of a portion of the rotary shaft that is located on the downstream side with respect to the toner conveying direction, and the third inclination angle is greater than 90 degrees.

3. An image forming apparatus for forming images with toner based on electrophotography, comprising:

a photoreceptor drum for forming an electrostatic latent image on a surface thereof;

a developing unit for forming a toner image by supplying toner to the electrostatic latent image on the surface of the photoreceptor drum;

a toner cartridge for supplying toner to the developing unit through a toner supply part;

a transfer device for transferring the toner image on the photoreceptor drum surface to a recording medium; and, a fixing device for fixing the transferred toner image to the recording medium, characterized in that the toner cartridge defined in claim 1 is used as the toner cartridge.

* * * * *